US011095074B2

(12) United States Patent
Zhu

(10) Patent No.: US 11,095,074 B2
(45) Date of Patent: Aug. 17, 2021

(54) ELECTRIC CONNECTION PLUG WITH LOCKING FUNCTION

(71) Applicant: Xiaoping Zhu, DongGuan (CN)

(72) Inventor: Xiaoping Zhu, DongGuan (CN)

( * ) Notice: Subject to any disclaimer, the term of this patent is extended or adjusted under 35 U.S.C. 154(b) by 0 days.

(21) Appl. No.: 16/842,805

(22) Filed: Apr. 8, 2020

(65) Prior Publication Data

US 2020/0235523 A1 Jul. 23, 2020

(51) Int. Cl.
*H01R 13/62* (2006.01)
*H01R 13/631* (2006.01)

(52) U.S. Cl.
CPC ..... *H01R 13/631* (2013.01)

(58) Field of Classification Search
CPC ..... H01R 13/631; H01R 13/62933; H01R 13/193; H01R 13/639; H01R 12/89
USPC ..... 439/372, 265
See application file for complete search history.

(56) References Cited

U.S. PATENT DOCUMENTS 2,261,615 A * 11/1941 Cornwell ..... H01R 13/193 439/265
2,851,669 A * 9/1958 Koch ..... H01R 13/20 439/265
3,858,956 A * 1/1975 Garrett ..... H01R 13/652 439/106
3,890,025 A * 6/1975 Gray ..... H01R 13/652 439/102
5,194,013 A * 3/1993 Propp ..... H01R 13/6392 439/102
5,249,976 A * 10/1993 Brock ..... H01R 13/20 439/102
2010/0300158 A1* 12/2010 Andres ..... G06F 1/16 70/58
2014/0157839 A1* 6/2014 Theobald ..... E05B 73/0005 70/58

* cited by examiner

*Primary Examiner* — Phuong K Dinh
(74) *Attorney, Agent, or Firm* — HYIP

(57) ABSTRACT

The present invention provides an electrical connection plug, comprising: a housing; an electrical connection point provided on the housing, to achieve electrical connection with a receptacle, wherein the receptacle has a jack; a locking component and an actuating component, both of which are provided on the housing, wherein the locking component is used to be inserted into the jack. The locking component comprises a latch, which is connected to the actuation component to be driven by the actuation component to move with respect to the housing, wherein the latch is provided with a first inclined surface; a locking plate, which is provided outside the latch, wherein the locking plate is provided with a second inclined surface corresponding to the first inclined surface. The present invention achieves the locking between the electrical connection plugs in a new way.

13 Claims, 10 Drawing Sheets

ELECTRIC CONNECTION PLUG WITH LOCKING FUNCTION

TECHNICAL FIELD

The present invention relates to the technical field of connectors, and in particular to an electrical connection plug.

BACKGROUND

Plugs are used in a wide range of fields, generally including plugs and receptacles. The plug is provided with a pin thereon as a male plug, and the receptacle is provided with a contact pin therein as a female plug. The pin can be inserted into the receptacle to make electrical contact with the contact pin in the receptacle to achieve electrical conduction of the power supply and electrical equipment. In, order to prevent the electrical connection from failing due to accidental disconnection between electrical connections, a locking device is usually provided on the electrical connection plug, for example, in CN101540455A and the like.

SUMMARY

The present invention provides an electrical connection plug, which achieves the locking between the plug and the receptacle in a new way.

The present invention provides an electrical connection plug, comprising:

a housing;

an electrical connection point provided on the housing to achieve electrical connection with a receptacle, wherein the receptacle has a jack;

a locking component and, an actuating component, both of which are provided on the housing, wherein the locking component is used to be inserted into the jack, and the locking component comprises:

a latch, which is connected to the actuation component to be driven by the actuation component to move with respect to the housing, wherein the latch is provided with a first inclined surface;

a locking plate, which is provided outside the latch, wherein the locking plate is provided with a second inclined surface corresponding to the first inclined surface, and when the latch moves with respect to the housing in the first movement direction, the first inclined surface acts on the second inclined surface to further expand the locking plate externally due to the stress to lock with the receptacle.

The present invention further provides a device using the electrical connection plug.

The present invention has the following beneficial effects: after, the electrical connection plug is plugged into the receptacle, the locking component is inserted into the jack, and the movement of the latch causes the first inclined surface to act on the second inclined surface, thereby further moving at least part of the locking plate away from the latch. As a result, the locking component becomes larger, and the locking plate and the receptacle are locked to achieve locking.

DESCRIPTION OF THE EMBODIMENTS

Figure 1:
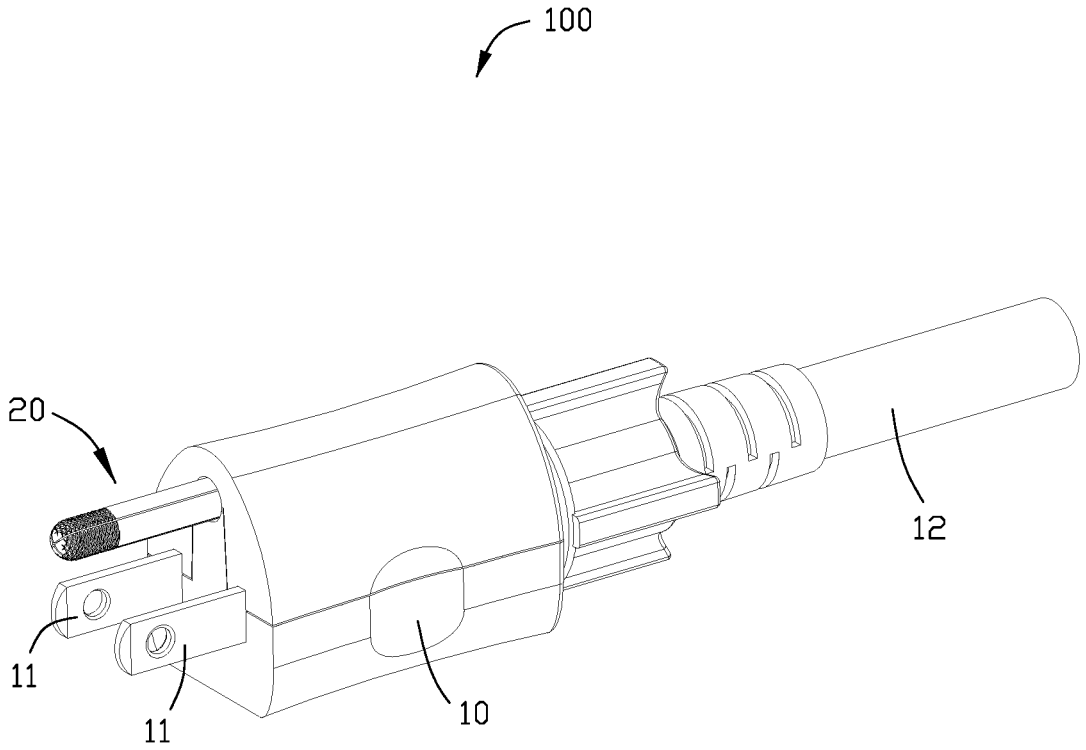
FIG. 1 is a schematic diagram of a structure of an electrical connection, plug according to the first specific embodiment of the present invention.

In the following, the technical solutions in the embodiments of the present invention will be clearly and completely described with reference to the drawings in the embodiments of the present invention. Obviously, the described embodiments are merely a part of the embodiments of the present invention, rather than all the embodiments. Based on the embodiments of the present invention, all other embodiments obtained by those skilled in the art without creative efforts shall fall within the protection scope of the present invention. It can be understood that the drawings are only provided for reference and description, and are not intended to limit the present invention. The connection relationship shown in the drawings is merely for the convenience of clear description, and does not limit the connection method.

Figure 2:
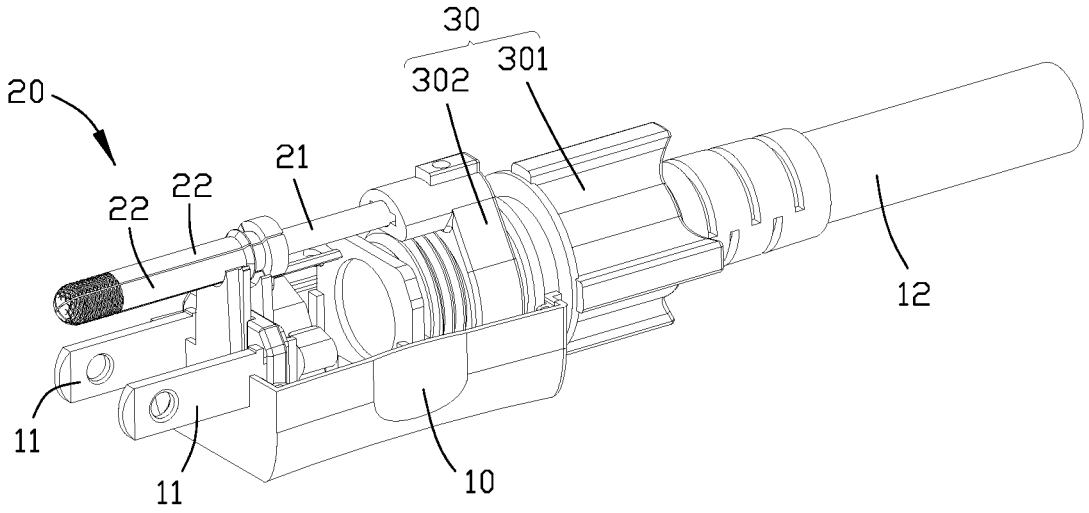
FIG. 2 is a schematic diagram of an internal structure of an electrical connection plug according to the first specific embodiment of the present invention.

FIG. 1 is a schematic diagram of a three-dimensional structure of an electrical connection plug 100 according to the first specific embodiment of the present invention. FIG. 2 is a schematic diagram of an internal structure of an electrical connection plug 100 according to the first specific embodiment of the present invention. In this embodiment, the electrical connection plug 100 comprises a housing 10 and two pins 11 in which a neutral wire is connected with a live wire, respectively. The pins 11 are electrically connected to a cable 12. The two pins 11 are fixed by the housing 10 and serve as electrical connection points for electrical connection with the two contact pins in the receptacle, respectively, so as to achieve the conduction of the neutral wire and the live wire.

Figure 3:
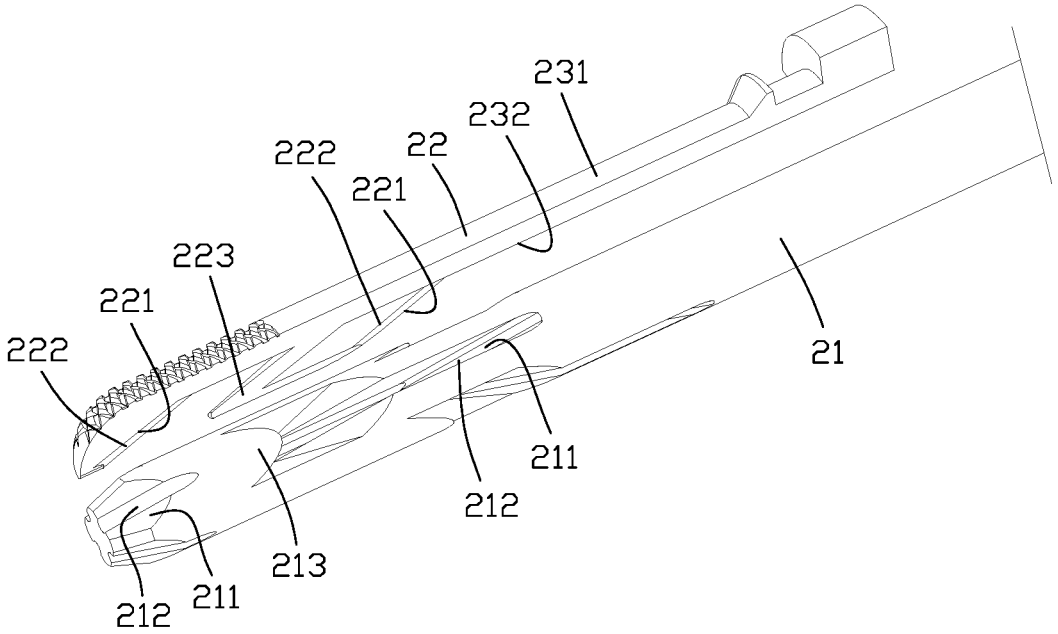
FIG. 3 is a schematic diagram of a structure of a latch and a locking plate according to the first specific embodiment of the present invention.
Figure 4:
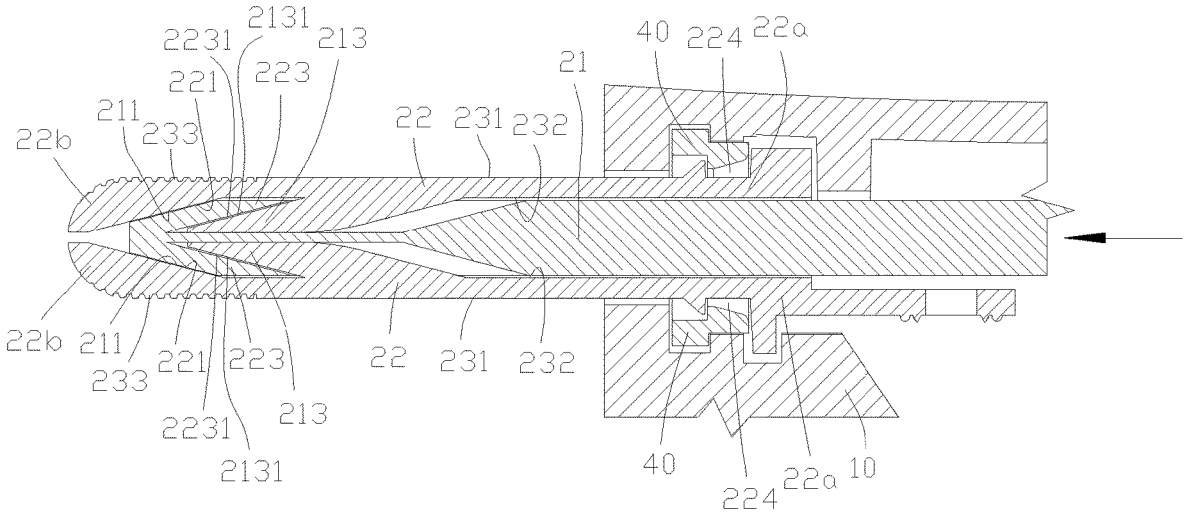
FIG. 4 is a schematic diagram of a structure of an electrical connection plug according to the first specific embodiment of the present invention when unlocked.
Figure 5:
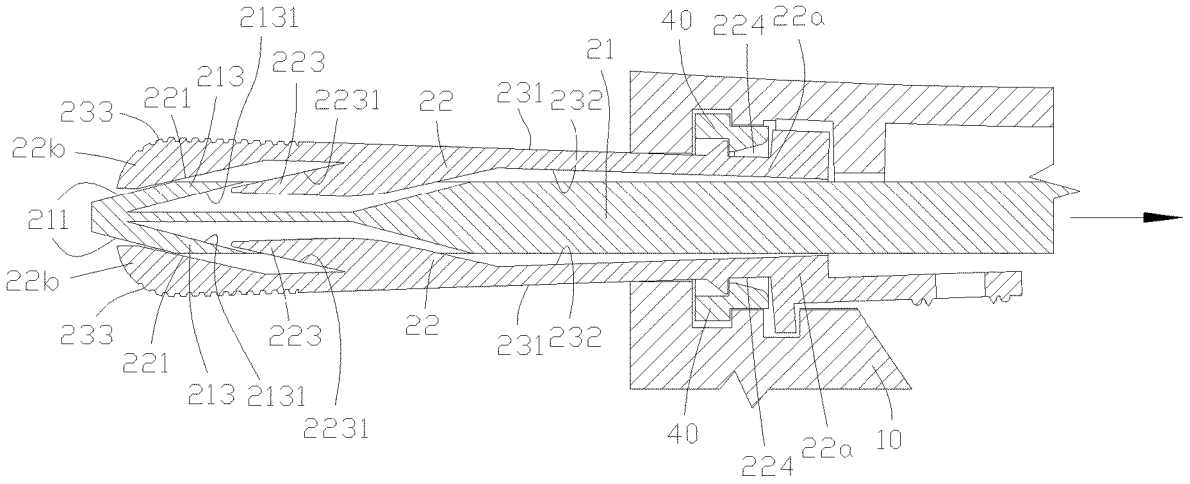
FIG. 5 is a schematic diagram, of a structure of an electrical connection plug according to the first specific embodiment of the present invention when locked.

Referring to FIGS. 3-5, a locking component 20 is provided on the housing 10. The locking component 20 may specifically comprise a latch 21 and a locking plate 22. The latch 21 may be a generally cylindrical structure. There may be one or more locking plates 22, for example, two or four. The locking plate 22 may be an arc plate generally corresponding to the shape of the latch 21. FIG. 3 is a corresponding structure diagram of a single locking plate 22 and the latch 21. When a plurality of locking plates 22 are included, when the locking plates 22 are in an unexpanded state, the locking plates 22 are distributed around the latch 21 in a ring array and cover the latch 21 to form an outer cover of the latch 21, so that the locking component 20 is bar-shaped and can be inserted into the jack of the receptacle.

In some specific embodiments, when the locking plate 22 is not expanded, the locking component 20 can be used as a pin of an electrical connection plug, such as a neutral wire pin, a live wire pin, or a ground wire pin. In this embodiment, when the locking plate 22 is not expanded, the locking component 20 is a ground wire pin. The existing ground wire socket in the receptacle can be used as the jack. There is no need to open the mold to provide another jack to save manufacturing costs. The socket can be suitable for the existing receptacles, and there is no, need to be equipped with new receptacles.

The locking plate 22 has an outer surface 231 facing away from the latch 21 and an, inner surface 232 facing the latch 21. The outer surface 231 of the locking plate 22 has a locking structure 233. The locking structure 233 may be a rough surface or non-slip layer provided on the outer surface 231 for increasing the frictional force, or a lock hook provided on the outer surface 231.

With continued reference to FIG. 2, the housing 10 is connected with an actuating component 30 for moving the latch 21. Specifically, the latch 21 moves forward and backward by the actuation component 30.

A first inclined surface 211 is provided on the latch 21, and the first inclined surface 211 may be provided on the front end of the latch 21. A second inclined surface 221 corresponding to the first inclined surface 211 is provided on the locking plate 22. When the latch 21 moves, the first inclined surface 211 moves with respect to the second inclined surface 221, and the first inclined surface 211 is in contact with the second inclined surface 221 so that the front end of the locking plate 22 gradually expands externally, the volume of the locking component 20 becomes larger, and the outer surface 231 of the locking plate 22 is locked with the receptacle.

The latch 21 moves with respect to the housing 10 so that the locking direction between the plug 100 and the receptacle is the first movement direction, which is the locking direction. The latch 21 moves in the reverse direction so that the loosening direction between the plug 100 and the receptacle is the second direction, which is the unlocking direction. The first inclined surface 211 is an inclined surface in the first movement direction in which the latch 21 is inclined with respect to the housing 10.

Referring to FIGS. 2-5, the actuation component 30 comprises a knob 301 rotatably connected to the housing 10 and provided with a thread, and a sliding sleeve 302 in threaded, connection with the knob 301. The sliding sleeve 302 is connected to the latch 21. The rotation motion of the knob 301 is converted into the forward and backward movement of the sliding sleeve 302 to achieve the forward and backward movement of the latch 21. The forward movement (the direction indicated by the arrow in FIG. 4) achieves locking, and the backward movement (the direction indicated by the arrow in FIG. 5) achieves unlocking. The first inclined surface 211 is an inclined surface inclined from the outer diameter to the inner diameter in a direction in which the latch 21 moves forward with respect to the housing 10.

The rear end 22*a* of the locking plate 22 is defined by a check ring 40 fixed to the housing 10. The check ring 40 constitutes a stopper part. Alternatively, the stopper part may be directly formed by the housing 10 to define the rear end 22*a* of the locking plate 22.

Figure 6:
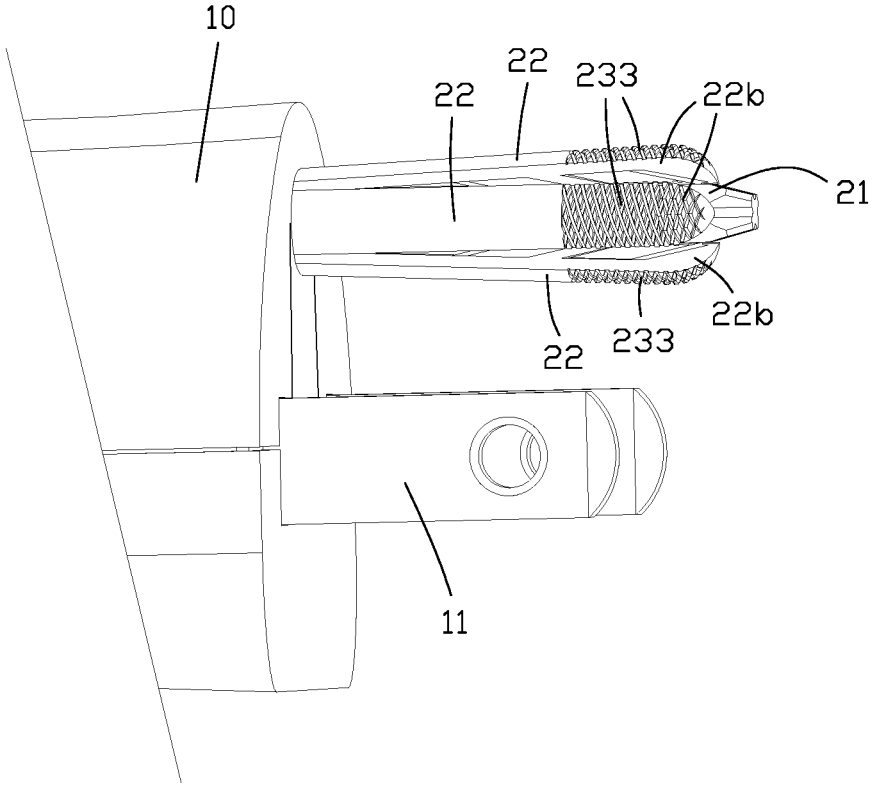
FIG. 6 is a state diagram of a locking plate of an electrical connection plug according to the first specific embodiment of the present invention when locked.
Figure 7:
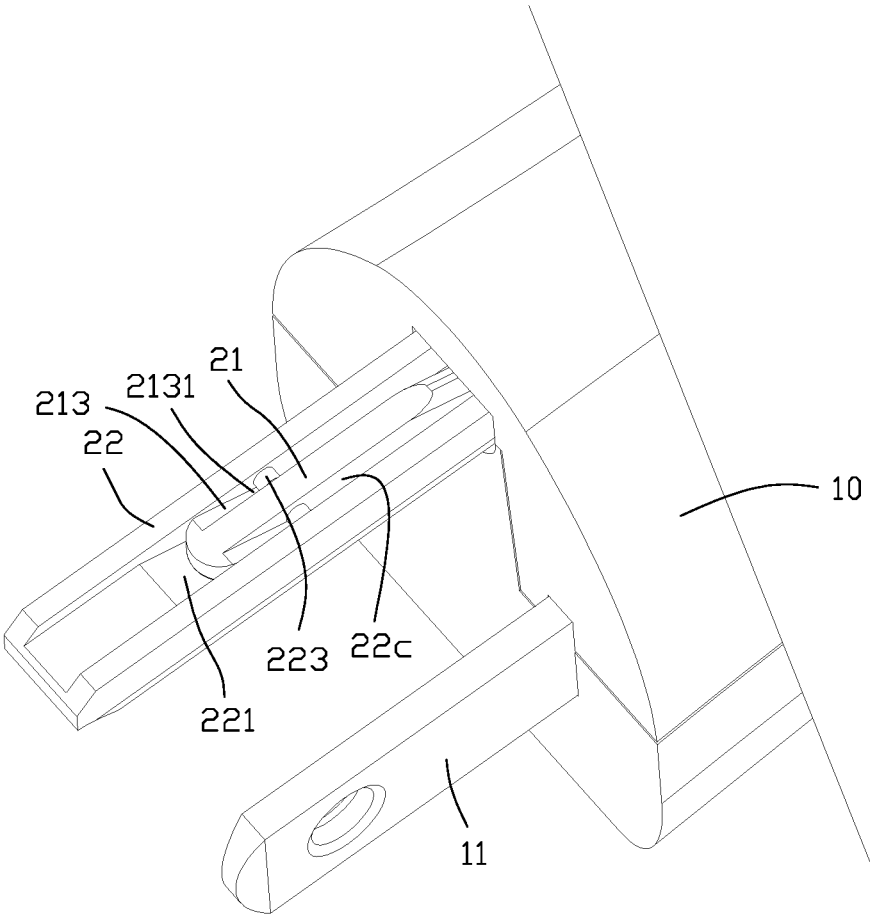
FIG. 7 is a schematic diagram of a part of a structure of an electrical connection plug according to the second specific embodiment of the present invention.
Figure 8:
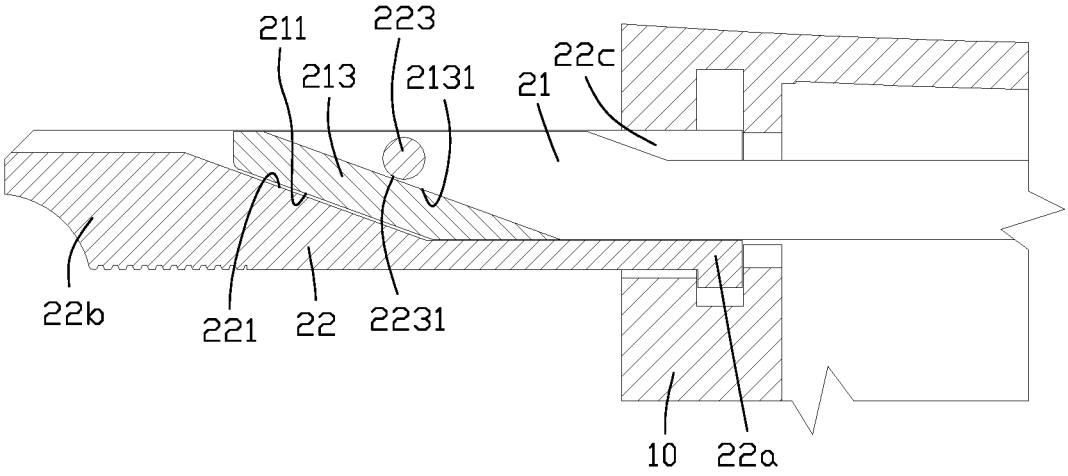
FIG. 8 is a schematic diagram of a structure of an electrical connection plug according to the second specific embodiment of the present invention when unlocked.
Figure 9:
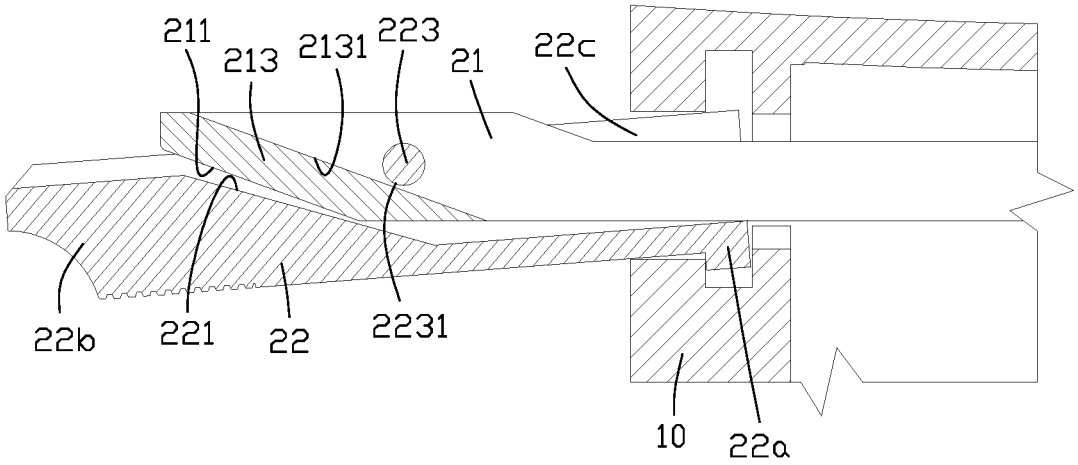
FIG. 9 is a schematic diagram of a structure of an electrical connection plug according to the second specific embodiment of the present invention when locked.
Figure 10:
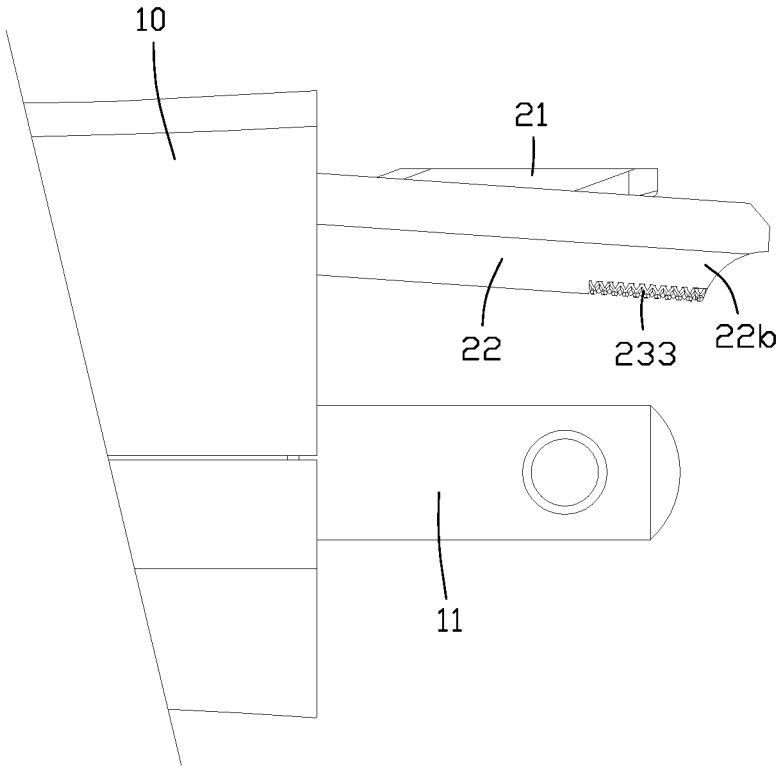
FIG. 10 is a state diagram of a locking plate of an electrical connection plug according to the second specific embodiment of the present invention when locked.

Specifically, the rear end 22*a* of the locking plate 22 has a locking groove 224, and the check ring 40 is provided in the locking groove 224. When the latch 21 moves forward and backward, the first inclined surface 211 acts on the second inclined surface 221, and the check ring 40 will prevent the locking plate 22 from moving forward and backward with the locking plate 22, but the front end 22*b* of the locking plate 22 is far away from the latch 21 and expands outward (refer to FIG. 6 together). The front end of the locking plate 22 spreads like a petal. The front end 22*b* of the locking plate 22 constitutes a gripper to be locked with the receptacle.

The first inclined surface 211 may be provided at the front end of the latch 21. The first inclined surface 211 at the front end of the latch 21 acts on the second inclined surface 221 of the locking plate 22. The first inclined surface 211 directly forces the front end 22*b* of the locking plate 22 to be locked with the receptacle, and the locking force is strong and stable. Of course, the first inclined surface 211 may also be provided at a middle section of the latch 21.

The latch 21 is formed with a first guide structure 212, and the locking plate 22 is formed with a second guide structure 222. The first guide structure 212 and the second guide structure 222 correspond to each other in position and there may be a plurality of structures. A first guiding structure 212 can be formed on the first inclined surface 211, and a second guiding structure 222 can be formed on the second inclined surface 221. The first guide structure 212 may be an inclined guide groove, and the second guide structure 222 may be an inclined guide block. The cooperation between the first guide structure 212 and the second guide structure 222 facilitates the guide of the locking plate 22 with respect to the latch 21 and prevents the first inclined surface 211 from being out of contact with the second inclined surface 221.

If the locking component 20 is used as a pin of the plug 100, the latch 21 or the locking plate 22 is made of conductive metal and connected to a wire, and the latch 21 or the locking plate 22 is a PIN where the pin and the electrical connection point at the jack of the receptacle are electrically connected. After the locking component 20 is inserted into the jack, the latch 21 is connected with the electrical connection point at the jack as the PIN. The locking plate 22 is locked with the housing 10 of the receptacle, or the locking plate 22 is locked with the electrical connection point while being locked with the electrical connection point of the receptacle as the PIN.

The latch 21 has a first blocking part 213, and the locking plate 22 has a second blocking part 223. The first hook part formed by the inner surface 232 of the locking plate 22 extending toward the front end constitutes a first blocking part 213, and the surface of the latch 21 is recessed toward the inner front end to form a groove. Thus, the latch 21 forms a second hook part to constitute a second blocking part 223. When the first hook part is provided in the groove and the locking plate 22 expands outward through the action of the latch 21, the first hook part restricts the second hook part from being detached. Further, the cooperation of the first blocking part 213 and the second blocking part 223 prevents the locking plate 22 from moving with respect to the latch 21 to be detached from the latch 21.

The first blocking part 213 has a first blocking surface 2131 and the second blocking part 223 has a second blocking surface 2231. The latch 21 moves forward with respect to the housing 10 so that the locking direction between the plug and the receptacle is a locking direction. In the forward direction, the first blocking surface 2131 is located at an outer end of the second blocking surface 2231. The first blocking surface 2131 and/or the second blocking surface 2231 are inclined in the same direction as the first inclined surface 211. When the latch 21 moves in the unlocking direction, the first blocking surface 2131 interacts with the second blocking surface 2231. The first blocking part 213 pulls back and lifts up the second blocking part 223, so that the locking plate 22 is restored. The locking plate 22 is restored to cover the latch 21. The latch 21 and the locking plate 22 are reconstituted into a bar shape, and the plug 100 can be removed from the receptacle.

The first inclined surface 211 and the second inclined surface 221 are always kept in contact, and the first blocking surface 2131 and the second blocking surface 2231 are also always kept in contact. When the locking plate is not expanded outward and is in the initial state, the first blocking surface 2131 is kept in contact with the second blocking surface 2231, which can, prevent the locking plate from loosening due to gravity (especially the locking plate 22 located below the latch 21). When the latch 21 moves, the first inclined surface 211 can directly act on the second inclined surface 221, reducing idle stroke of the latch 21.

Referring to FIGS. 7-10, FIGS. 7-10 show a schematic diagram of a structure of an electrical connection plug according to the second specific embodiment of the present invention. The main difference from the first specific embodiment lies in the structure of the latch 21 and the locking plate 22. Other corresponding structures of the first specific embodiment mode can be applied to the second specific embodiment.

In the second specific embodiment, the locking plate 22 has a U-shaped groove 22*c*, so that the locking plate 22 is substantially U-shaped, the second inclined surface 221 is provided in the U-shaped groove 22*c*, and the latch 21 is provided in the U-shaped groove 22*c*. The width of latch 21 is substantially the same as the width of the U-shaped groove 22*c*, so that the U-shaped groove 22*c* can be used as a guide structure when the latch 21 moves forward and backward.

The two inner side walls of the U-shaped groove 22*c* are extended with a stopper 223. The stopper 223 preferably has a cylindrical structure. The stopper 223 serves as a second blocking part 223. The stopper 223 is spaced from the first inclined surface 211. The second blocking surface 2231 on the stopper 223 is preferably an arc surface, such as a circular arc surface. The front surface of the first blocking part 213 of the latch 21 is a first inclined surface 211, and the rear surface of the first blocking part 213 of the latch 21 is a first blocking surface 2131. The first blocking surface 2131 is substantially parallel to the first inclined surface 211. The first blocking part 213 is provided in the gap between the stopper 223 and the first inclined surface 211, so that the first inclined surface 211 corresponds to the second inclined surface 221, and the first blocking surface 2131 corresponds to the second blocking surface 2231.

When the latch 21 moves forward to be locked, the first inclined surface 211 acts on the second inclined surface 221, and the front end of the locking plate 22 expands outward. The cooperation of the second blocking surface 2231 and the first blocking surface 2131 prevents the locking plate 22 from being detached from the latch 21 due to gravity. When the latch 21 is moved backward to be locked, the second inclined surface 221 pulls back and lifts up the stopper 223 while moving toward the rear end, and the locking plate 22 is restored.

In a third specific embodiment (not shown), the latch is driven by an actuating component (such as a knob) to achieve a rotation motion. The first inclined surface is an inclined surface gradually inclined from the inner diameter to the outer diameter in a direction in which the latch rotates with respect to the housing. The principle is similar to that when the latch moves forward and backward, and a corresponding structure is provided to prevent the locking plate from being detached and restore the locking plate when unlocked, which will not be described herein in detail. A limiting groove can be formed at the rear end of the locking plate. The check ring fixed to the housing and provided with a limiting block can prevent the locking plate from rotating with the latch. The limiting block is provided in the limiting groove. When the latch is rotated, the first inclined surface acts on the second inclined surface, and the front end of the locking plate is far away from the latch and expands outward.

The above description is only a preferred embodiment of the present invention and is not intended to limit the present invention. Any modification, equivalent substitution and improvement made within the spirit and principles of the present invention shall be included in the scope of protection of the present invention.

What is claimed is:

1. An electrical connection plug, comprising:

a housing;

an electrical connection point provided on the housing to achieve electrical connection with a receptacle, wherein the receptacle has a jack;

a locking component and an actuating component both of which are provided on the housing, wherein the locking component is used to be inserted into the jack, and the locking component comprises:

a latch, which is connected to the actuation component to be driven by the actuation component to move with respect to the housing, wherein the latch is provided with a first inclined surface;

a locking plate, which is provided outside the latch, wherein the locking plate is provided with a second inclined surface corresponding to the first inclined surface, and when the latch moves with respect to the housing in the first movement direction, the first inclined surface acts on the second inclined surface to further expand the locking plate externally due to the stress to lock with the receptacle, wherein the latch has a first blocking part, the locking plate has a second blocking part, and the first blocking part and the second blocking part cooperate to prevent the locking plate from moving away from the latch with respect to the latch, the first blocking part has a first blocking surface, the second blocking part has a second blocking surface, and the first blocking surface and or the second blocking surface have the same inclined direction as the first inclined surface, so that when the latch moves in the reverse direction, the first blocking surface acts on the second blocking surface to restore the locking plate, the first inclined surface and the second inclined surface are always kept in contact and the first blocking surface and the second blocking surface are also always kept in contact.

2. The electrical connection plug according to claim 1, comprising at least two locking plates, and at least two of the locking plates are distributed outside the latch.

3. The electrical connection plug according to claim 1, wherein a locking structure is provided on an outer surface of the locking plate.

4. The electrical connection plug according to claim 3, wherein the locking structure is one or more of a rough surface, a non-slip layer, and a lock hook.

5. The electrical connection plug according to claim 1, wherein the latch moves forward and backward by the actuation component.

6. The electrical connection plug according to claim 1, wherein the latch is recessed from a surface to an inner front end to form a groove so that the latch forms the first blocking part, and the second blocking part is provided in the groove.

7. The electrical connection plug according to claim 1, wherein the locking plate has a U-shaped groove, the second inclined surface is provided in the U-shaped groove, the second blocking part is a stopper which is formed by extending the inner wall of the U-shaped groove, and the first blocking part is provided between the stopper and the first inclined surface.

8. The electrical connection plug according to claim 1, wherein the first inclined surface and the second inclined surface are always kept in contact and the first blocking surface and the second blocking surface are also always kept in contact.

9. The electrical connection plug according to claim 6, wherein the first inclined surface and the second inclined surface are always kept in contact and the first blocking surface and the second blocking surface are also always kept in contact.

10. The electrical connection plug according to claim 1, wherein the latch is formed with a first guide structure, the locking plate is formed with a second guide structure, and the first guide structure and the second guide structure cooperate to facilitate the guide of the locking plate when moving with respect to the latch.

11. The electrical connection plug according to claim 1, wherein the locking component constitutes a pin of the electrical connection plug, and the latch or the locking plate is a PIN where the pin and the electrical connection point at the jack are electrically connected.

12. The electrical connection plug according to claim 1, wherein the housing is provided with a stopper part, and the end of the locking plate is stopped by the stopper part to prevent the locking plate from moving in the same direction with the latch.

13. A device, wherein the device uses the electrical connection plug according to claim 1.

* * * * *